US006447037B1

(12) United States Patent
Crouch

(10) Patent No.: US 6,447,037 B1
(45) Date of Patent: Sep. 10, 2002

(54) METHOD AND DEVICE FOR CARRYING AND SECURE TRANSPORTATION OF A PLURALITY OF BAGS

(76) Inventor: Lawrence Andrew Crouch, P.O. Box 35273, Charlotte, NC (US) 28235

( * ) Notice: Subject to any disclaimer, the term of this patent is extended or adjusted under 35 U.S.C. 154(b) by 4 days.

(21) Appl. No.: 09/633,977

(22) Filed: Aug. 8, 2000

(51) Int. Cl.[7] ..... B65D 33/06
(52) U.S. Cl. ..... 294/149; 294/150; 294/165
(58) Field of Search ..... 294/74, 137, 149, 294/150, 152, 158, 159, 165, 170; 24/17 A, 17 B, 17 AP, 30.5 P

(56) References Cited

U.S. PATENT DOCUMENTS

| | | | | | |
|---|---|---|---|---|---|
| 2,522,719 | A | | 9/1950 | Johnson | 224/28 |
| 2,985,480 | A | * | 5/1961 | Otley | 105/354 |
| 3,294,299 | A | | 12/1966 | Brennan | 224/28 |
| 3,493,154 | A | * | 2/1970 | Engle | 294/150 |
| 3,592,502 | A | * | 7/1971 | Bolliger | 294/152 |
| 3,919,740 | A | * | 11/1975 | Scherb | 24/198 |
| 3,997,943 | A | * | 12/1976 | Jones et al. | 24/16 PB |
| 4,815,642 | A | | 3/1989 | Ray | 224/258 |
| 4,958,758 | A | | 9/1990 | Tipple et al. | 224/267 |
| 4,982,522 | A | | 1/1991 | Norton | 42/85 |
| 5,005,891 | A | | 4/1991 | Lunsford | 294/171 |
| 5,082,156 | A | | 1/1992 | Braun | 224/220 |
| 5,096,248 | A | * | 3/1992 | Ryan | 294/150 |
| 5,234,245 | A | * | 8/1993 | Peterson et al. | 294/149 |
| 5,511,846 | A | | 4/1996 | Fuller | 294/149 |
| 5,620,127 | A | | 4/1997 | MacKenzie | 224/555 |
| 5,660,309 | A | | 8/1997 | Belanger | 224/250 |
| 5,695,234 | A | * | 12/1997 | Coticchio et al. | 294/152 |
| 5,758,808 | A | | 6/1998 | Epps et al. | 224/257 |
| 5,762,242 | A | | 6/1998 | Yost | 224/250 |
| 5,816,460 | A | | 10/1998 | Cook | 224/260 |
| 5,895,972 | A | | 4/1999 | Brown | 224/267 |

* cited by examiner

*Primary Examiner*—Dean J. Kramer
(74) *Attorney, Agent, or Firm*—Kennedy Covington Lobdell & Hickman, LLP

(57) ABSTRACT

Multiple handle-type bags, particularly plastic grocery bags, may be gathered for carrying and transportation by utilizing a flattened flexible strap with loop portions at its opposite ends. The strap is inserted through the collected handle openings of the bags to draw the handles together and, then, one end of the strap is inserted through the loop portion of the other strap end to close and cinch the other strap end about the handles. The bags may then be manually carried as a group by grasping the loop portion of the one strap end either within the fingers of user's hands or about the user's wrist.

7 Claims, 7 Drawing Sheets

METHOD AND DEVICE FOR CARRYING AND SECURE TRANSPORTATION OF A PLURALITY OF BAGS

BACKGROUND OF THE INVENTION

The present invention relates generally to the field of bags with handles for the manual carrying of goods and merchandise, such as are commonly dispensed to patrons of retail establishments for carrying and transportation of purchased items. More particularly, the present invention relates to a novel device and method of using the same for gathering and holding the handles of a plurality of such bags for ease of carrying and secure transportation thereof.

Retail establishments ranging from grocery stores to hardware and department stores have traditionally provided to their patrons one or more carrying bags for the goods or merchandise purchased. Since such bags are almost always provided on a complimentary basis, merchandisers prefer and normally use bags which are inexpensive and disposable. In the past, retail merchandise bags were most commonly made of paper, but in more recent years, bags made of a thin-walled plastic material have largely replaced paper bags. Such plastic bags offer the advantage to the retailer of being equally if not more inexpensive than paper bags, are lighter in weight yet still relatively strong, and do not weaken when wet as do paper bags. In further contrast to paper bags, such plastic bags may be easily provided with integrated carrying handles as part of the manufacturing process and without significant additional expense by forming corresponding openings in opposing side walls of the bags.

As a result, plastic bags of the aforementioned type have come into prevalent use in most retail establishments, but perhaps most notably in supermarkets and grocery stores. On the one hand, because these plastic bags are typically manufactured with a smaller volumetric capacity than the paper bags heretofore commonly used in supermarkets and grocery stores and are also more susceptible than paper bags to puncturing and tearing due to the very thin wall thickness of the plastic material, the maximum practical capacity in weight and volume of goods each individual plastic bags is capable of safely carrying is considerably less than that of an individual paper bag. On the other hand, because of the typically larger volume and number of items purchased by the patrons of supermarkets and grocery stores on a normal shopping visit in comparison to other types of retail establishments, the integrated handles of these plastic bags offer the advantage of enabling a customer to manually carry multiple bags of merchandise in each hand and, hence, to carry a significantly larger weight and volume of merchandise than is typically possible using paper bags.

Unfortunately, in carrying multiple plastic bags, the weight of the merchandise in the bags typically causes the plastic material of the handles to be pulled taut and thereby to narrow within the user's hands into a thin cord-like or wire-like configuration. Hence, when carrying multiple bags collectively comprising a significant amount of weight and volume, the handle material of the bags often tends to bind and cut into the user's hands making it difficult and uncomfortable to carry the bags for any significant distance.

Also, because such plastic bags do not have the stiffness of paper bags, such plastic bags do not have sufficient structural integrity to be self-standing or otherwise to maintain on their own an opened upright configuration. Hence, when such bags have been filled with merchandise and are then placed into the trunk or onto the seat of an automobile to be transported from the supermarket or grocery store, the merchandise contained therein tends to readily shift about and often causing items to spill out of the bags, which is not only annoying but can result in heavier items damaging more fragile items.

SUMMARY OF THE INVENTION

It is accordingly an object of the present invention to address and overcome the aforementioned disadvantages of plastic carrying bags, with the expectation and desire that the carrying capacity and advantages of such bags may be optimized. More specifically, it is an object of the present invention to provide a novel device and a method of using such a device by which a user may gather for easy carrying and secure transportation of a plurality of such bags without pain or discomfort to the user's hands and with minimized risk of spillage of goods from the bags.

Basically, the present invention is adapted for use with substantially any bags of the type having a carrying handle defining a handle opening and adapted for containing and transporting manually carriable goods, such as, for example, the above-described plastic bags used in supermarkets and grocery stores.

According to one aspect of the present invention, a novel device is provided which enables the handles of multiple such bags to be gathered for carrying such bags collectively as a group. Briefly summarized the device is a strap having an elongate body opposite ends which are formed as loop portions each defining an opening therethrough. The body is flexible with the loop portions being configured relative to one another such that each loop portion is capable of insertion through the opening of the other loop portion.

According to the method of use of the device contemplated by the present invention, a plurality of bags is first collected with the respective handles of the bags situated relative to one another so as to dispose the handle openings generally in close adjacency to one another. The strap is then inserted through the handle openings of the bags and the handles of the bags are then drawn together by means of the strap so as to expose the opposite ends of the strap at least partially outside the handle openings of the bags. One end of the strap is then inserted through the opening defined by the loop portion of the other end of the strap until the loop portion of such other end closes about the handles of the bags to secure them together. The bags may then be manually carried as a group by grasping the loop portion of the one end of the strap, either by grasping the loop portion thereof within the user's fingers or by the user inserting his or her hand and wrist through the loop portion such that the user may grasp a medial extent of the strap within his or her fingers using the wrist to bear the weight of the bags therein.

Advantageously, when the one end of the strap is inserted through the opening defined by the loop portion of the other end of the strap, the loop portion of the latter end of the strap forms into a knot cinched about the handles of the bags, which will tend to retain the handles of the bags collectively together when the bags are set by the user into an automobile trunk, onto an automobile seat, onto a table or counter, or any other surface, even after the strap is released by the user and the bags are permitted to relax, thereby to prevent the goods contained within the bags from spilling or otherwise escaping.

In a preferred embodiment, the device of the present invention is fabricated of a band-like material having a flattened transverse extent of a uniform transverse dimension along the full lengthwise extent of the strap, e.g., a narrow-width textile fabric. The loop portions of the strap are formed by free ends of the band being folded and secured to a medial lengthwise extent of the strap, preferably at a common medial location along the strap forming the loop portions to be of like dimensions and configurations.

These and other objects, features and advantages of the device and method of the present invention will be described in and be apparent from the disclosure of a preferred embodiment set forth hereinafter with reference to the accompanying drawings.

DETAILED DESCRIPTION OF THE PREFERRED EMBODIMENT

Figure 1:
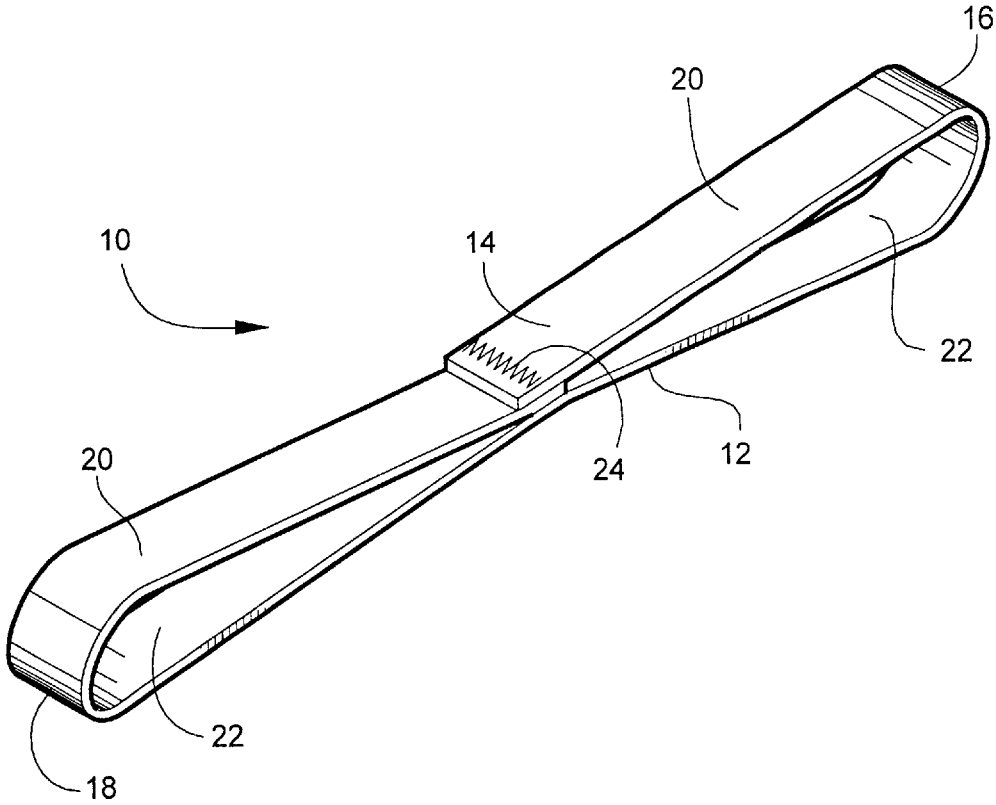
FIG. 1 is a perspective view of a preferred embodiment of the device of the present invention.

Referring now to the accompanying drawings and initially to FIG. 1, a device in accordance with the present invention is indicated in its totality at 10 and basically comprises a strap 12 having an elongated body 14 the opposite ends 16, 18 of which are configured as closed loop portions 20 each defining an opening 22.

The strap 12 is preferably fabricated from an elongated length of a flattened band or webbing optimally having a uniform transverse dimension across its flattened transverse extent along the full lengthwise extent of the band. A relatively heavy-duty narrow-width textile fabric made of high tensile strength, high-denier yams woven or warp-knitted into a flexible but essentially non-stretchable belting material is most preferred, but substantially any elongated band-like or web-like material of sufficient flexibility to be formed into a knot and of sufficient lengthwise tensile strength and resistance to stretching to be capable of supporting the weight of multiple merchandise bags may also be used.

As shown in FIG. 1, the strap 12 is formed by folding the opposite free ends of the band-like material to a common medial location along the length of the strap body 14, preferably at the lengthwise center point thereof at 24, at which the free ends of the band are sewn to the body 14 thereby forming the loop portions 20 to be of substantially the same configuration and dimension. Optimally, the loop portions 20 are of a sufficient size for substantially any user's hand to be inserted therethrough but, for safety reasons, sufficiently small that the loop portions 20 will not pass over the head of a small child.

The normal intended use of the device 10 may thus be understood with reference to FIGS. 2–7. Each such figure depicts a plurality of conventional plastic grocery bags 26 of the type currently in common use by most supermarkets and grocery stores within the United States. As shown and as is well known, such bags are typically fabricated of a sheet-like plastic material of a very thin cross-sectional thickness which is fabricated into a sack-like body 28 closed at its lower end 30 and with a pair of openings 32 formed in opposed side walls 34 adjacent the upper end 36 of the sack body 28 to form carrying handles 38.

Figure 2:
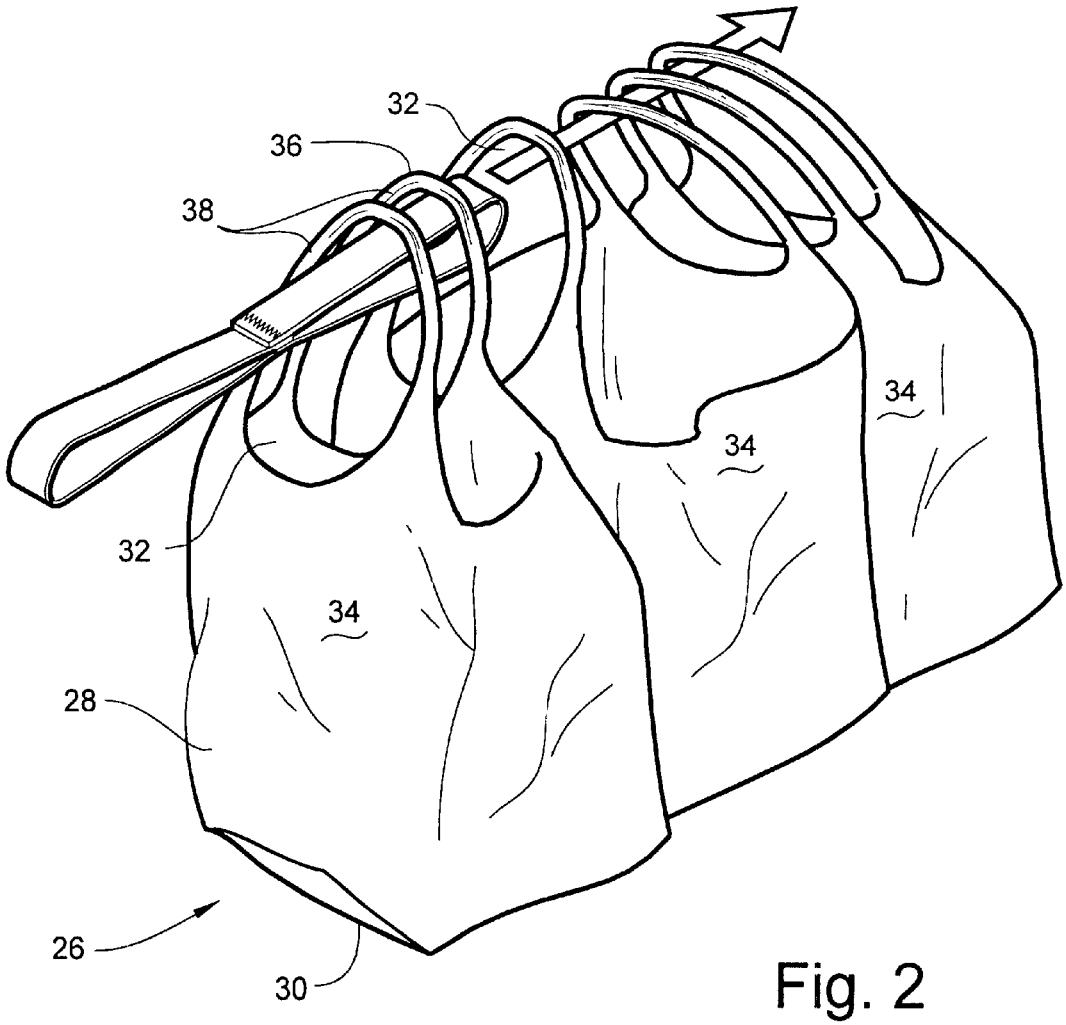
FIGS. 2–7 are perspective views illustrating, in sequence, the steps of the method of the present invention in utilizing the device of FIG. 1.
Figure 3:
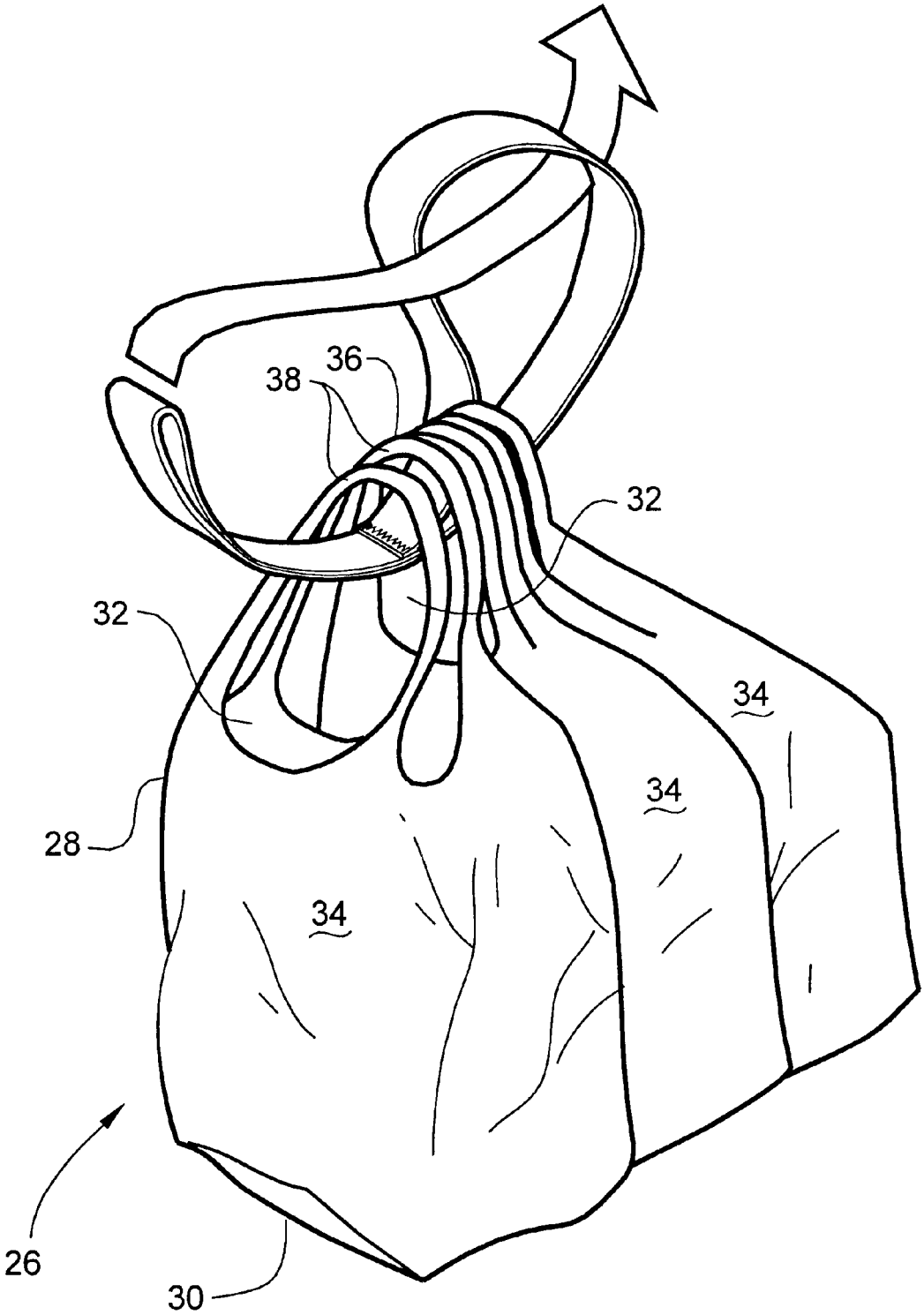
Figure 4:
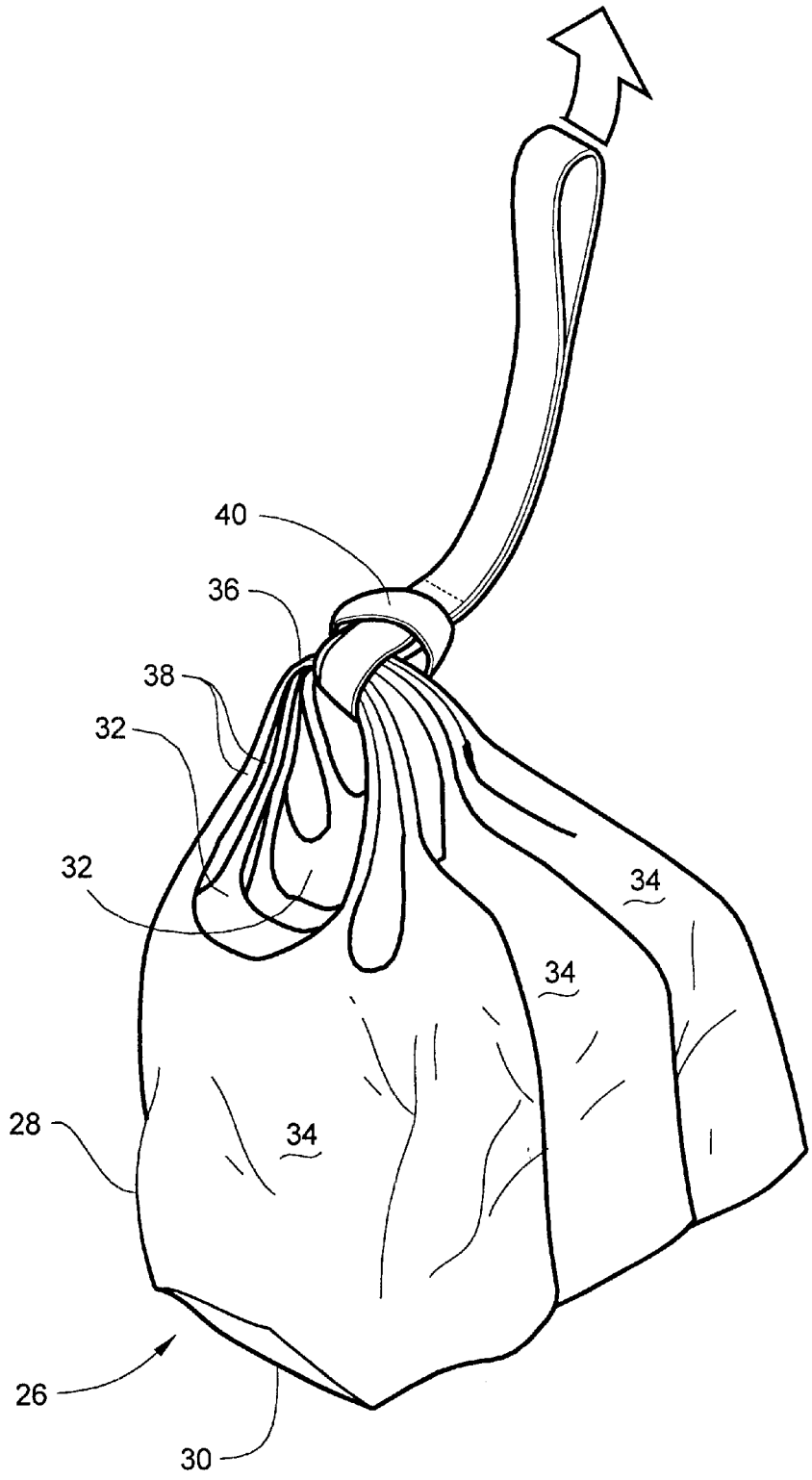

As depicted in FIG. 2, the multiple grocery bags 26 are initially collected such that their respective carrying handles 38 are situated with their openings 32 generally in close adjacency to one another, preferably in general alignment. The device 10 is then utilized to gather the carrying handles 38 of the bags 26 by inserting the strap 12 through the adjacent handle openings 32 of each of the bags 26 and to draw the handles 38 of the bags 26 together, as shown in FIG. 3. In doing so, the opposite ends 16, 18 of the strap 12 are exposed outside the handle openings 32 of the bags 26, whereby one end 16 of the strap 12 may be inserted through the opening 22 defined by the loop portion 20 of the other end 18 of the strap 12, as shown in FIG. 4. As the end 16 of the strap 12 is pulled progressively through the other strap end 18, the strap end 18 closes and cinches into the form of a knot 40 about the carrying handles 38 of the collected bags 26, thereby securing the handles 38 together.

Figure 5:
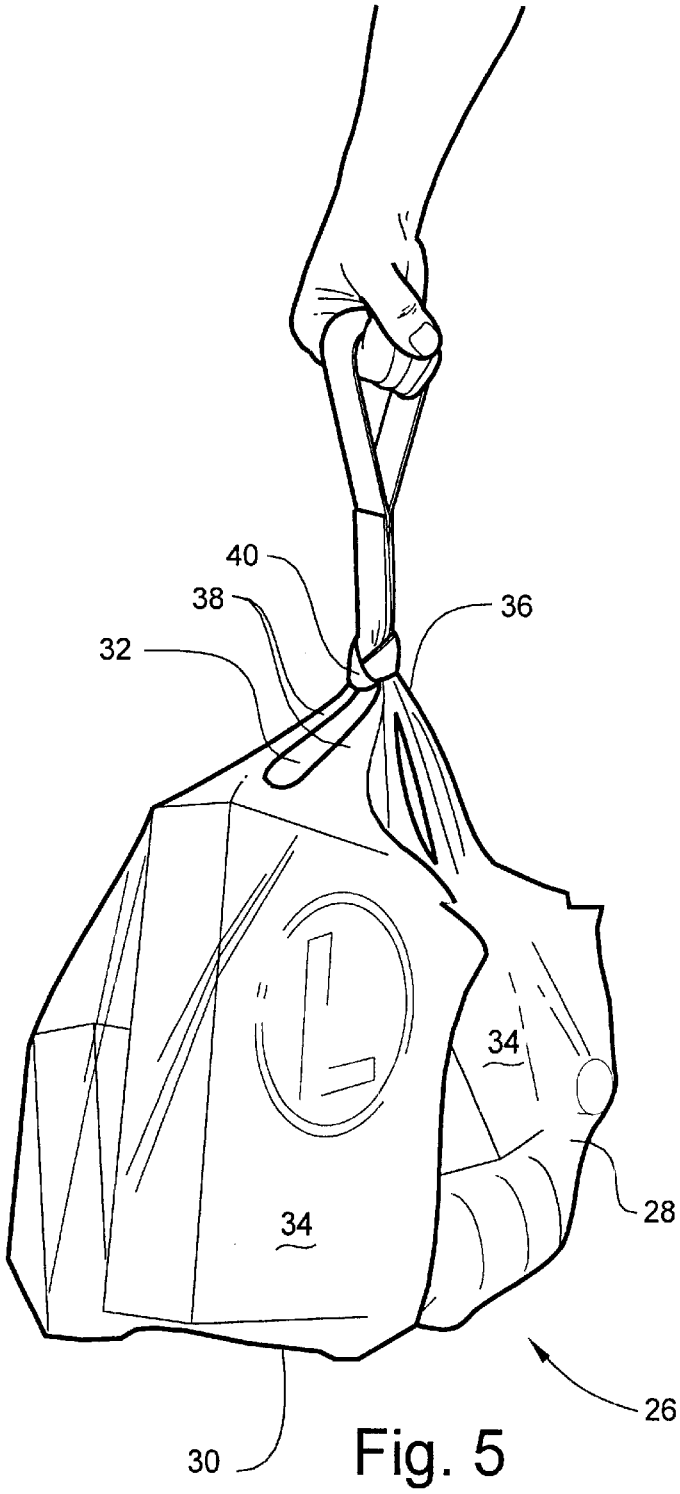
Figure 6:
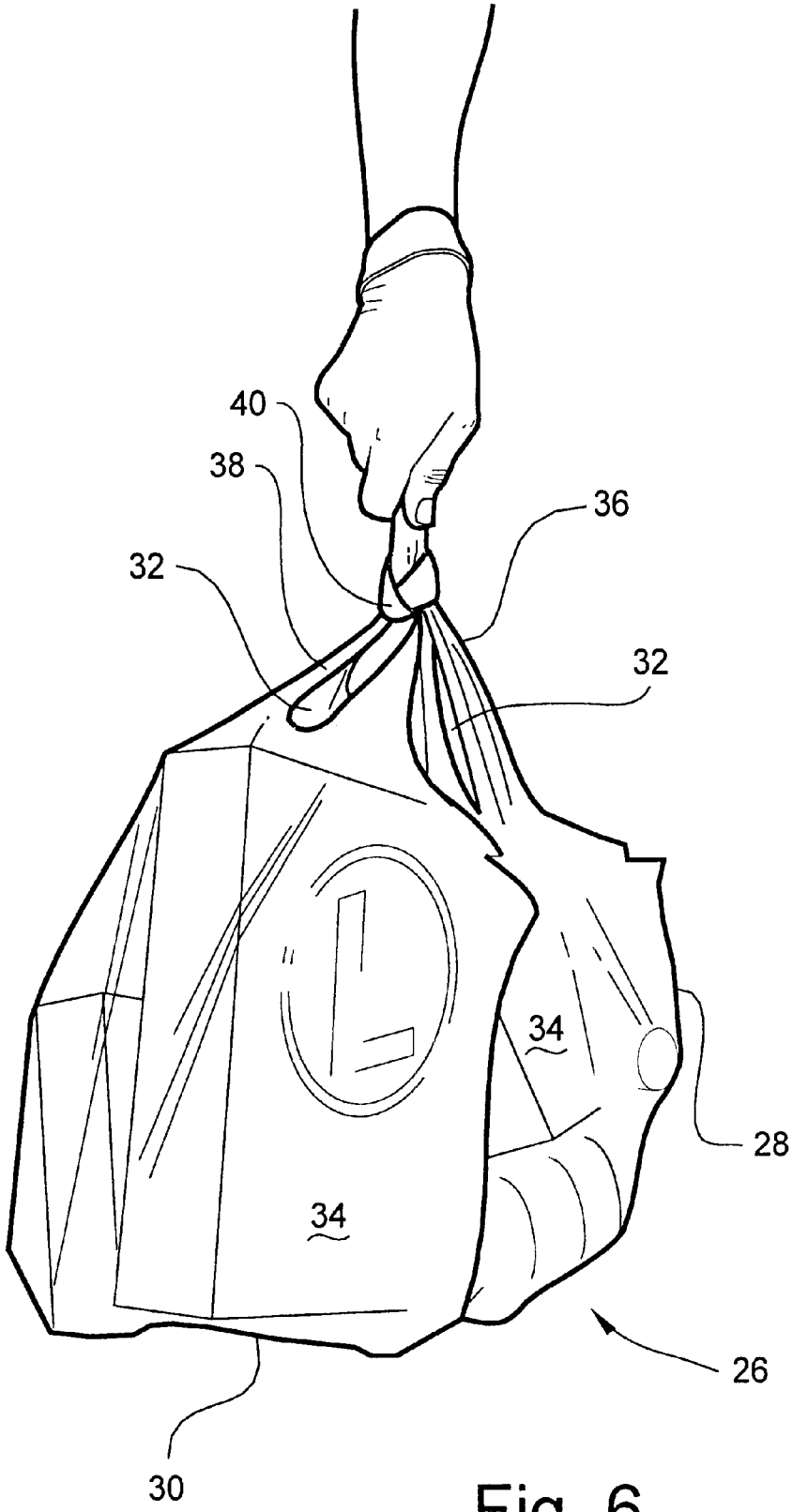

With the device 10 thusly secured to the bags 26, the plural bags 26 may be readily carried as a group by grasping the loop portion 20 of the strap end 16 within the fingers of a user's hand and thereby suspending the bags from the hand, as shown in FIG. 5. Alternatively, the user may extend his or her hand and wrist completely through the loop portion 20 of the end 16 of the strap 12 such that the collective weight of the bags 26 and their contents is suspended from and borne by the user's wrist. For stability, the user grasps the medial extent of the strap 12 within the fingers of the user's hand, as is shown in FIG. 6. This manner of carrying the bags 26 is particularly useful when carrying a larger number of bags 26 or when heavier goods are contained within the bags 26.

Figure 7:
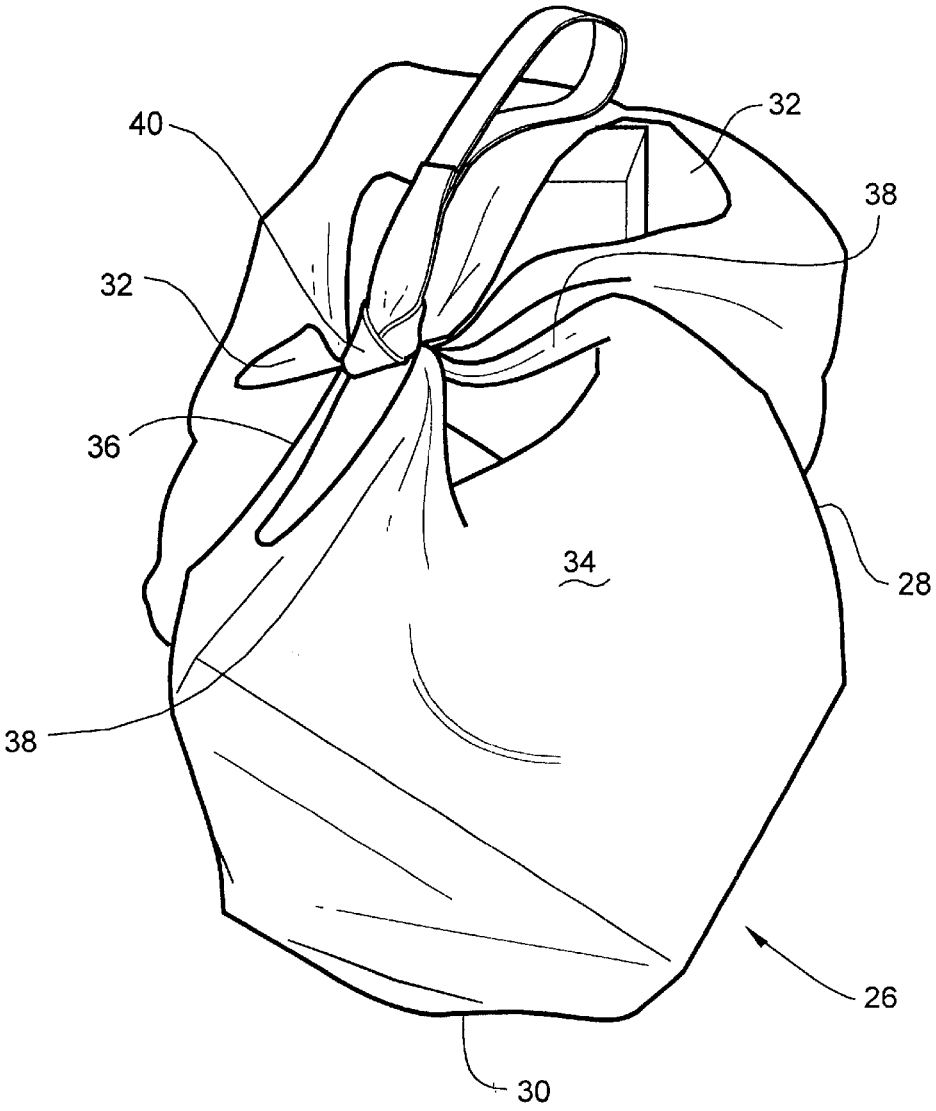

The advantages of the present invention will be apparent from the foregoing disclosure. First, the device and method of the present invention enable a user to avoid the discomfort of holding a collective group of the handles 38 of multiple bags 26 directly within the user's hands and the binding and cutting sensation which particularly occurs if the collective load of the bags 26 is heavy. The flattened form of the strap 12 provides a much more comfortable feel within the user's fingers and/or on the user's wrist and effectively spreads the collective load of the bags 26 to prevent any binding or cutting sensation. As a net result, a user can effectively carry a greater number of bags without discomfort. Moreover, the device 10 may remain cinched to the collective bag handles 38 when the bags are placed into the trunk or other storage compartment or onto the seat of a user's automobile and when the bags are placed onto a table or counter, whereby the device 10 effectively holds the upper opening of the bags essentially closed while the bags are being transported, as is illustrated in FIG. 7. In this manner, the tendency of the bags to shift and permit spillage of their contents if otherwise left unsecured is avoided.

Because of the recognized disadvantages of the use of plastic carrying bags without the device and method of the present invention, it is common for supermarkets and grocery stores to limit the number of items placed into each plastic grocery bag, whereby the weight and volumetric capacity of such bags is seldom fully realized and, in turn, such retail establishments incur an increased cost associated with the use of such bags than is actually necessary. Hence, it is contemplated that, if the device and method of the present invention is used systematically by customers of such establishments, it would become possible to utilize the full volumetric and weight-bearing capacity of such bags and, in turn, to reduce the rate at which such establishments utilize such bags and the attendant costs thereof, which could result in incrementally lower costs to the consumer and/or incrementally increased profits to the retail establishment.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A device for gathering for easy carrying and secure transportation a plurality of bags of the type for containing and transporting manually carriable goods, each of which bags has a carrying handle defining a handle opening, the device comprising a strap for collecting and supporting the plurality of bags as a collective group, the strap comprising an elongate body having opposite ends formed as loop portions each defining an opening therethrough, the body being flexible and the loop portions thereof being configured relative to one another such that each loop portion is capable of insertion through the opening of the other loop portion, the body being configured to be insertable through the handle openings of the plurality of bags when collected together as a group and for drawing of the handles of the bags together with the opposite ends of the strap at least partially exposed outside the handle openings of the bags so as to facilitate insertion of one end of the strap through the opening defined by the loop portion of the other end of the strap for closure of the loop portion of the other end of the strap about the collected handles of the bags to secure the handles of the bags together.

2. A device for gathering a plurality of bags according to claim 1, wherein the loop portions of the strap are of like dimensions and configurations.

3. A device for gathering a plurality of bags according to claim 1, wherein the strap comprises an elongate band having a flattened transverse extent.

4. A device for gathering a plurality of bags according to claim 3, wherein the band is of a uniform transverse dimension across the flattened transverse extent thereof along the full lengthwise extent of the strap.

5. A device for gathering a plurality of bags according to claim 3, wherein the band is formed of a narrow-width textile fabric.

6. A device for gathering for easy carrying and secure transportation a plurality of bags of the type for containing and transporting manually carriable goods, each of which bags has a carrying handle defining a handle opening, the device comprising a strap for collecting and supporting the plurality of bags as a collective group, the strap comprising an elongate band having a flattened transverse extent of essentially uniform transverse dimension along the full length of the band, the band having opposite free ends folded and secured to a common medial location along the band forming an elongate strap body having opposite ends formed as loop portions of like dimensional and configurations each defining an opening therethrough.

7. A device for gathering a plurality of bags according to claim 6, wherein the band is formed of a narrow-width textile fabric.

* * * * *